United States Patent [19]

Huang

[11] Patent Number: 5,051,969

[45] Date of Patent: Sep. 24, 1991

[54] DECORATIVE CLOCK WITH ROTATABLE SAND PICTURE

[75] Inventor: Chen- Sung Huang, Changhua Hsien, Taiwan

[73] Assignee: Chien Hua Glass Co., Ltd., Changhua Hsien, Taiwan

[21] Appl. No.: 442,867

[22] Filed: Nov. 29, 1989

[51] Int. Cl.[5] ..... G04B 19/02

[52] U.S. Cl. ..... 368/223; 368/229; 368/93

[58] Field of Search ..... 368/91, 93, 94, 95, 368/223-239

[56] References Cited

U.S. PATENT DOCUMENTS

| | | | |
|---|---|---|---|
| 1,850,184 | 3/1932 | Spainhower | 368/223 |
| 2,488,483 | 11/1949 | Thatcher | 368/223 |
| 3,616,640 | 11/1971 | Resnicoff | 368/229 |

*Primary Examiner*—Bernard Roskoski

*Attorney, Agent, or Firm*—Browdy and Neimark

[57] ABSTRACT

A decorative clock with sand picture having the function of showing flowing picture and correct time mainly consists of a gear set housing, a sand picture, and a set of hour hand and minute hand assembled together to be positioned on a support seat in such a manner that the sand picture may freely rotate to form a flowing picture without affecting the correct indication of time by the hour hand and the minute hand.

2 Claims, 6 Drawing Sheets

DECORATIVE CLOCK WITH ROTATABLE SAND PICTURE

BACKGROUND OF THE INVENTION

A. Prior art and shortcomings thereof

In the prior art, a decorative clock with a sand picture 2 (please see FIG. 1) mainly consists of two transparent plates 211 forming a close space 212 therebetween to contain liquid and colored fine sands which form a sand picture 21; and a clock 22 located after the sand picture at a certain interval Both the sand picture and the clock are fixed into a frame 23. The clock 22 may be seen through the front transparent plate 211 of the sand picture 21 while the fine sands in the close space 212 gradually flow to show a dynamic picture.

As a decorative means for general consumers, there are shortcomings existing in such picture clock:

1. The fine sands will deposit downward and eventually become opaque and consequently hinder the display of time on the clock.

2. The clock 22 and the sand picture 21 are stationarily fixed onto the frame 23. When the sands in space 212 all deposited downward to the bottom, the picture 21 together with the clock 22 must be turned over to generate new flowing picture which will make the clock 22 reversed and showing incorrect time.

3. For the purpose to let the clock stand, the shape of the same is limited to rectangle or other polygons.

4. Prior design of such clock is only suitable for putting on table top or the like rather than hanging, because the clock could not be turned over when it is hung on somewhere, and, consequently, the sand picture would lose it function, too.

B. Methods to resolve above-mentioned shortcomings

With a purpose to eliminate the shortcomings existing in the prior art of decorative clock with sand picture, the invention hereof is specifically providing a through-hole on the picture for a projected shaft from the gear set housing of the clock to put through from the back of the picture, and to pivotly connect an hour-hand and a minute-hand at the front of the picture; a hanger and a receiving seat provided on a pair of supports are also provided to position the clock and the picture in such a manner that the picture may freely rotate without affecting the correct indication of time by the hour-hand and minute-hand.

DESCRIPTION OF THE INVENTION

It is a major object of the invention to provide a clock with a sand picture of which is freely rotatable and will not affect the clock while it is rotating.

Another object of the invention is to provide a clock with a sand picture which can be placed on table tops or be hung from anywhere.

A further object of the invention is to provide a clock with a sand picture which can be of any shape so as to enhance its function in decoration.

The present invention can be best understood through the following description and accompanying drawings wherein:

DETAILED DESCRIPTION OF THE PREFERRED EMBODIMENT

Figure 1:
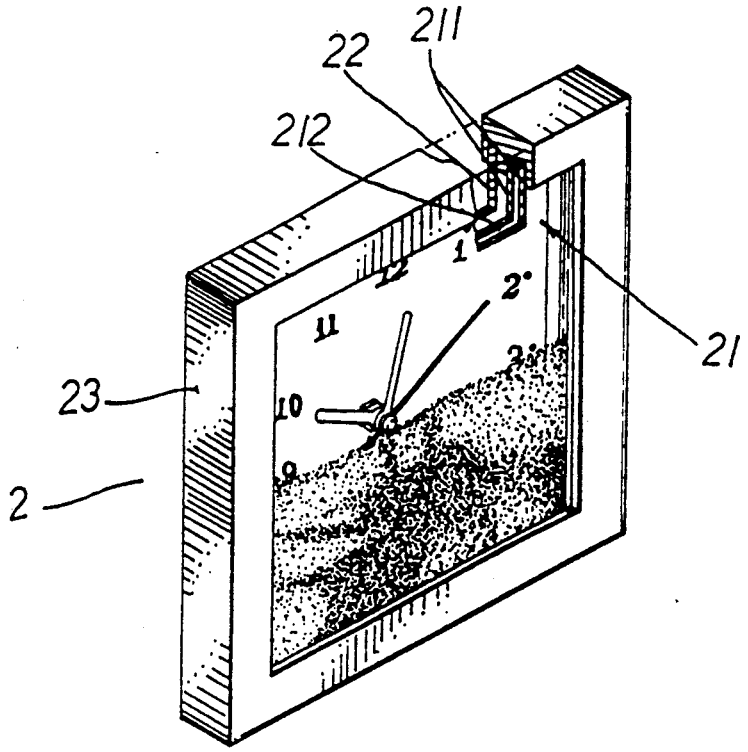
FIG.1 (PRIOR ART)
FIG. 1 is a three-dimensional perspective view of common clock with sand picture, with partial sectional view to show the relationship of clock with sand picture.
Figure 2:
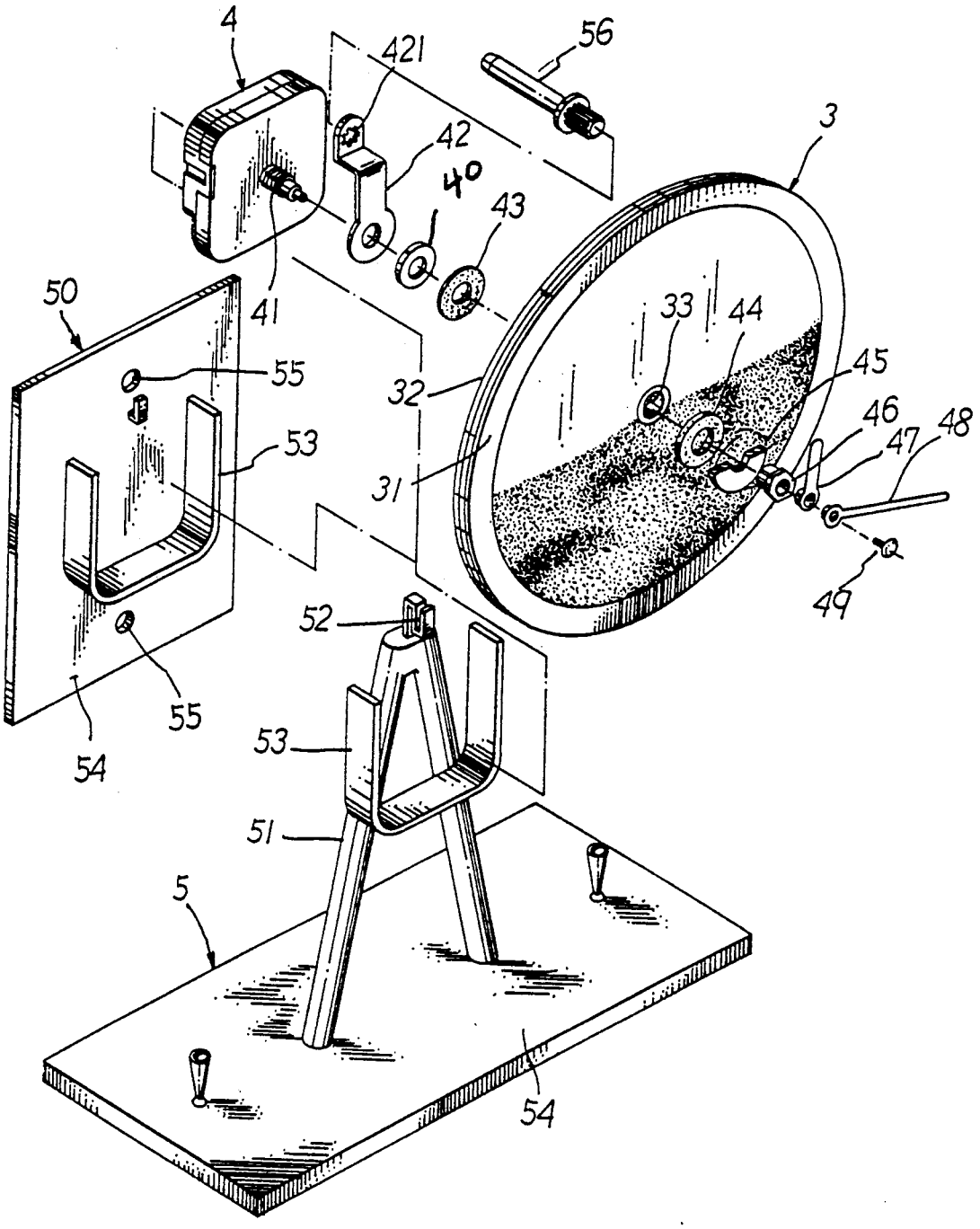
FIG. 2 is a three-dimensional analytical perspective of the present invention.
Figure 3:
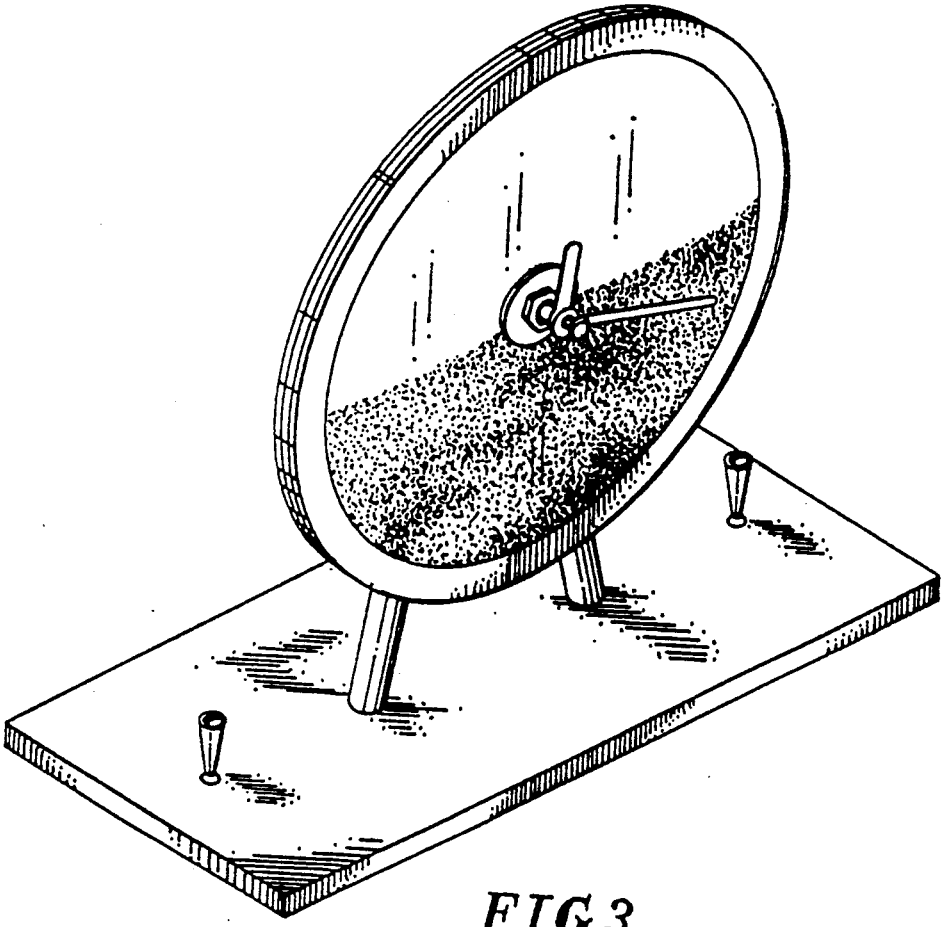
FIG. 3 is a three-dimensional perspective of the present

Referring to FIGS. 2 and 3, the present invention includes two substantially similar-shape plates 31, 32 being arranged in such a manner that the front plate 31 is a transparent one and is at a distance from the rear plate 32 which is an opaque plate or a mirror; a through-hole 33 is formed at the center of the plates 31, 32; both the circumferences of the hole 33 and the plates 31 and 32 are sealed so that a closed space is formed between plates 31 and 32 to contain liquid and colored fine sands to make a flowing picture 3.

Figure 4:
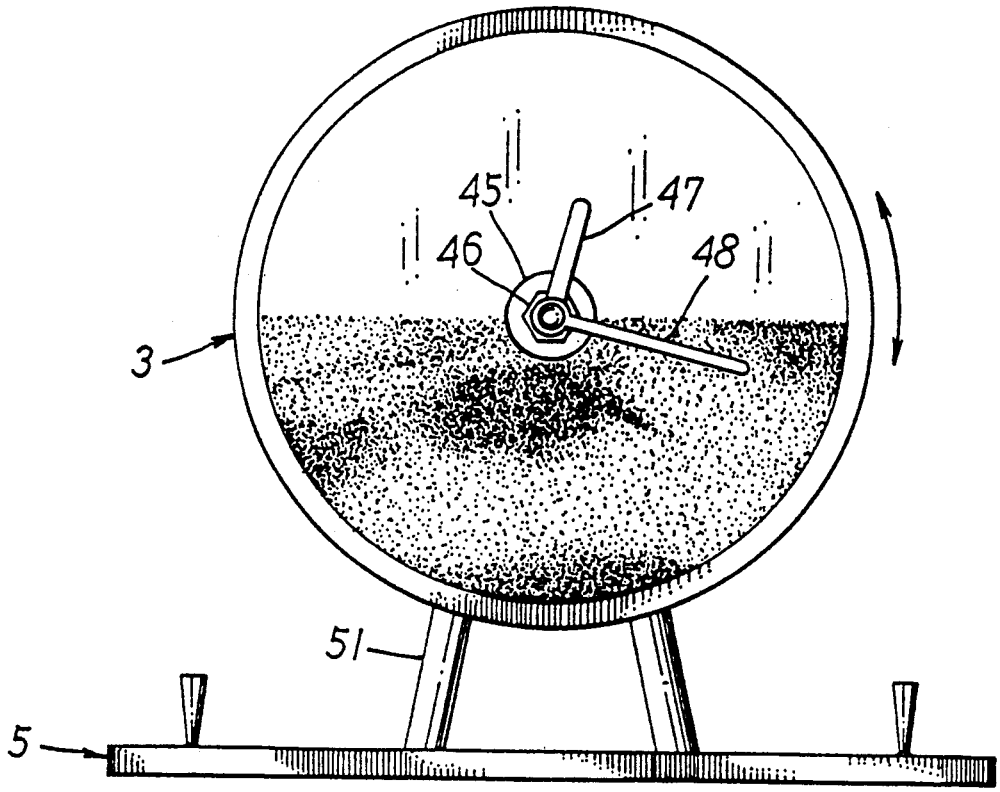
FIG. 4 is a front view of the present invention.

A gear set housing or a common electronic clock driving set housing 4 has a fixing shaft 41, onto which a hanging plate 42 having a hanging hole 421 with indented inner circumference, a washer 40, and a elastic washer 43 are put. After the fixing shaft 41 is passed through the through-hole 33, a elastic washer 44 and a washer 45 can be put onto the still projected portion of the fixing shaft 41 and be fixed by a nut 46 which has a outer diameter equal to the inner diameter of hole 33 so that the picture 3 may pivotally rotate relatively to the gear set housing 4; then, an hour hand 47 and a minute hand 48 may be fixed at the front of the picture 3 (as shown in FIG. 4) onto the nut 46 by a fixing bolt 49.

A seat 5 of any shape has a seat body 54 on which one or more supports 51 are provided. At the upper end of the supports 51, a hanger 52 is provided to receive the hanging hole 421 on the hanging plate 42. A U-shaped receiving seat 53 is provided at a proper location on the supports 51 below the hanger 52 to receive the gear set housing 4: or, as shown in FIG. 2, the receiving seat 53 may be integrally formed with the seat body 54 while a hanger 52 is directly projectedly formed on the upper portion of the seat body 54, and two or more holes 55 are formed for fixing the whole seat 50 so formed by the seat body 54, receiving seat 53, and the hanger 52 onto a wall surface or the like with screws. Or, a fixing bolt 56 with indented circumference head may be used to secure the gear set housing 4 together with the picture 3 and other parts onto a wall surface and the like.

Figure 5:
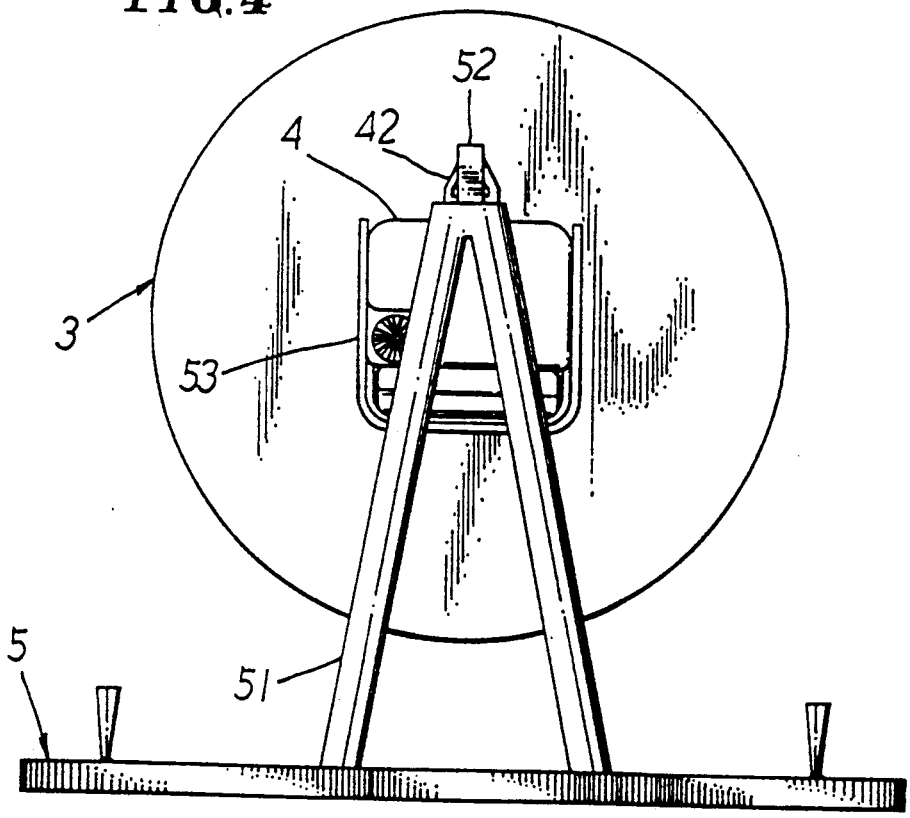
FIG. 5 is a rear view of the present invention.
Figure 6:
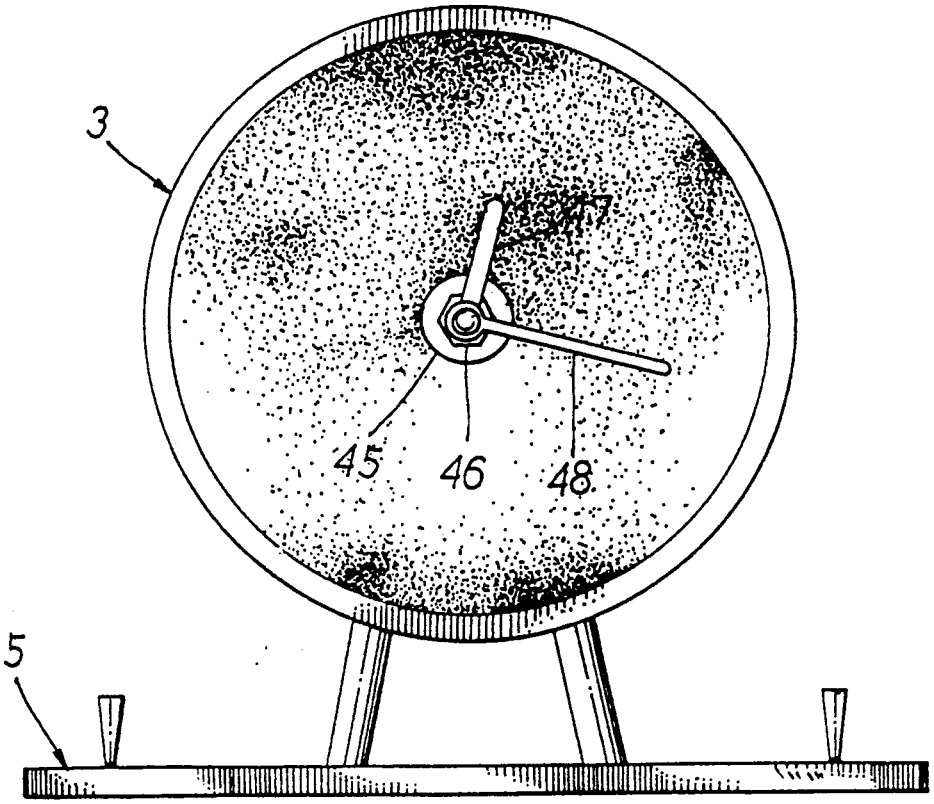
FIG. 6 is a front view of the present invention showing a . flowing picture appears after the picture is turned.

When the gear set housing 4 and the clock and the sand picture 3 are supported by the receiving seat 53 and the hanger 52 on the seat 5, the whole clock with sand picture (the present invention) may be used as a clock as well as a decorative article (as shown in FIG. 5).

Although the gear set housing 4 and the hanging plate 42 are stationarily placed in the receiving seat 53, the sand picture 3 itself is still rotatable by any force applied on it while the hour hand and the minute hand will not turn along with the picture.

Figure 7:
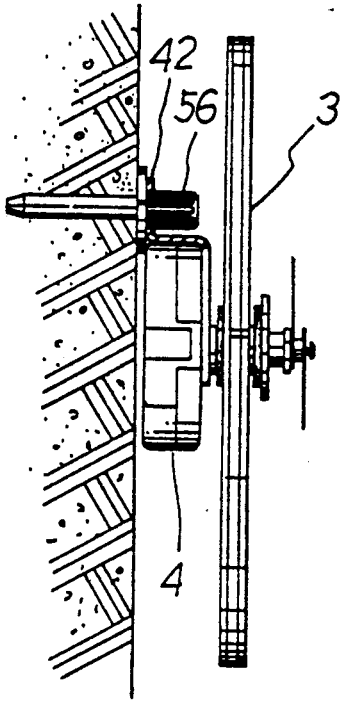
FIG. 7 and 8 show the two different ways to fix the present invention onto a wall surface.
Figure 8:
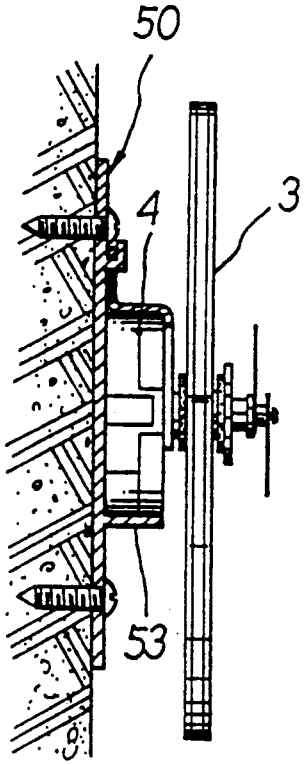

Please see FIG. 7, when the present invention is direct fixed to a wall surface by the fixing bolt 56, or, as shown in FIG. 8, is fixed to the wall by screwing the seat 50 onto the wall surface, it may be hung instead of being placed at some table top while the sand picture 3 can still be freely rotated to form a flowing picture.

Therefore, the present invention could not only eliminate the shortcomings existing in the prior art of sand picture clock, but also provide following advantages:

1. The sand picture may be freely rotated to form a flowing picture at any time/

2. The turning of sand picture will not affect the correct indication of time by the hour hand and minute hand.

3. The shape of sand picture may be of any kind.

4. The present invention may be either placed on a table top or hung on a wall surface to be used as decorative article while giving correct time indication.

5. The sand picture may be used as a mirror if the rear plate 32 of the picture is a mirror.

I claim:

1. A decorative clock with rotatable sand picture comprising:

a sand picture having a through hole formed at the center thereof;

a clock gear set housing having a projecting fixing shaft for receiving a hanging plate;

said plate having a preformed hanging hole, a first washer, and a first elastic washer;

said shaft passing through said through hole at the center of said sand picture, and said shaft receiving a second elastic washer and a second washer after it has passed said center hold on said picture;

a nut screwed into said shaft for holding together said gear set housing, said hanging plate, said first washer, said first elastic washer said sand picture, said second elastic washer, and said second washer; such that said sand picture is rotatable an hour hand an a minute hand secured to said shaft with a fixing bolt at the front of said sand picture;

a seat provided with a pair of supports there on;

a U-shaped receiving set formed to receive said gear set housing; and a hanger provided at the top portion of said supports for receiving said hanging plate.

2. A decorative clock with rotatable sand picture comprising:

a sand picture having a through hole formed at the center thereof;

a clock gear set housing having a projection fixing shaft for receiving a hanging plate;

said plate having a preformed hanging hole, a first washer, and a first elastic washer;

said shaft passing through said through hole at the center of said sand picture, and said shaft receiving a second elastic washer and a second washer after it has passed said center hole on said picture;

a nut screwed into said shaft for holding together said gear set housing, said hanging plate, said first washer, said first elastic washer, said sand picture, said second washer, and said second elastic washer such that said sand picture is rotatable;

an hour hand and a minute hand secured to said shaft with a fixing bolt at the front of said sand picture;

a seat integrally formed to have a projected hanger, a U-shaped receiving seat, and a number of holes so that said gear set housing as well as said clock with said sand picture can be positioned onto said integrally formed seat and be hung on a wall surface by fixing said seat to the wall with screws through said holes.

* * * * *